US009267511B2

(12) United States Patent
Ikeda et al.

(10) Patent No.: US 9,267,511 B2
(45) Date of Patent: Feb. 23, 2016

(54) TURBOFAN AND INDOOR UNIT OF AIR-CONDITIONING APPARATUS INCLUDING THE SAME

(75) Inventors: Takashi Ikeda, Tokyo (JP); Takahide Tadokoro, Tokyo (JP); Masahiko Takagi, Tokyo (JP); Makoto Kurihara, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 752 days.

(21) Appl. No.: 13/582,933

(22) PCT Filed: Mar. 24, 2011

(86) PCT No.: PCT/JP2011/001718
§ 371 (c)(1),
(2), (4) Date: Sep. 5, 2012

(87) PCT Pub. No.: WO2011/121943
PCT Pub. Date: Oct. 6, 2011

(65) Prior Publication Data

US 2012/0328420 A1 Dec. 27, 2012

(30) Foreign Application Priority Data

Mar. 29, 2010 (JP) ..... 2010-074052

(51) Int. Cl.
*F04D 25/08* (2006.01)
*F04D 29/30* (2006.01)
*F04D 29/66* (2006.01)
*F04D 29/28* (2006.01)

(52) U.S. Cl.
CPC ..... *F04D 29/281* (2013.01); *F04D 29/30* (2013.01)

(58) Field of Classification Search
CPC ..... F04D 25/08; F04D 29/24; F04D 29/242; F04D 29/245; F04D 29/281; F04D 29/30; F04D 29/66; F04D 29/661; F04D 29/663; F04D 29/667; F04D 29/68; F04D 29/681
USPC ..... 416/235, 236 R
See application file for complete search history.

(56) References Cited

U.S. PATENT DOCUMENTS 5,074,376 A * 12/1991 Powell ..... 181/277
7,066,712 B2 * 6/2006 Kim et al. ..... 415/58.4
2009/0028719 A1 1/2009 Teraoka et al.

FOREIGN PATENT DOCUMENTS

JP 9-126190 A 5/1997
JP 2669448 B2 10/1997

(Continued)

OTHER PUBLICATIONS

Office Action issued on Sep. 23, 2014, by the Chinese Patent Office in corresponding Chinese Patent Application No. 201180016013.2, and an English Translation of the Office Action. (7 pages).

(Continued)

*Primary Examiner* — Craig Kim
*Assistant Examiner* — Jason Davis
(74) *Attorney, Agent, or Firm* — Buchanan, Ingersoll & Rooney PC

(57) ABSTRACT

Blades forming a turbofan included in an indoor unit each have, in a blade outer-circumferential surface of the blade and near a blade rear-edge portion, a plurality of rear-edge horizontal grooves extending horizontally (in a plane perpendicular to a center of rotation) with predetermined lengths L2 reaching the blade rear-edge portion. The rear-edge horizontal grooves are each a combination of a groove recessed portion provided with a predetermined depth in the blade outer-circumferential surface and a groove wrapping portion continuous with the groove recessed portion and provided at the terminal end of the blade rear-edge portion. The rear-edge horizontal grooves are provided in a region extending upward from the main plate defined by a distance H1 and in a region extending downward from the shroud defined by a distance H2.

10 Claims, 10 Drawing Sheets

(56) References Cited

FOREIGN PATENT DOCUMENTS

| | | | |
|---|---|---|---|
| JP | 3092554 | B2 | 9/2000 |
| JP | 2007-292053 | A | 11/2007 |

OTHER PUBLICATIONS

International Search Report (PCT/ISA/210) issued on Jun. 21, 2011, by the JapanesePatent Office as the International Searching Authority for International Application No. PCT/JP2011/001718.

* cited by examiner (a)

(b)

TURBOFAN AND INDOOR UNIT OF AIR-CONDITIONING APPARATUS INCLUDING THE SAME

TECHNICAL FIELD

The present invention relates to turbofans and indoor units of air-conditioning apparatuses including the same, and in particular to a turbofan that sends out humidified or dehumidified air or heated or cooled air and an indoor unit of an air-conditioning apparatus, the indoor unit including the turbofan.

BACKGROUND ART

Hitherto, turbofans including three-dimensionally shaped fan blades have been widely employed as air-sending fans included in indoor units of ceiling-concealed air-conditioning apparatuses. Specifically, a turbofan is configured to take in air from a portion thereof on the inner circumferential side and to blow out the air toward the outer circumferential side thereof and includes a disc-shaped main plate, a ring-shaped shroud facing the main plate, and a plurality of blades (wings) each having two ends thereof connected to the main plate and the shroud, respectively. Several inventions have been disclosed in response to demands for more silent operation (noise reduction).

For example, there is a technology in which a rear edge portion of each blade extending in the width direction of the blade has a "saw-tooth shape" defined by a line angled alternately toward two sides in the longitudinal direction of the blade, (see Patent Literature 1, for example).

In another technology, each blade has, on a rear edge portion of a front surface (positive-pressure surface) thereof in the direction of rotation, a plurality of "ribs" provided parallel to one another at predetermined intervals and extending in a direction perpendicular to a rotating shaft (see Patent Literature 2, for example).

In yet another technology, each blade has "riblets" provided over the entirety or a portion of the pressure-receiving-surface side thereof on a rotating shaft of the impeller (see Patent Literature 3, for example).

CITATION LIST

Patent Literature

Patent Literature 1: Japanese Patent No. 3092554 (pp. 4 to 5 and FIG. 1)

Patent Literature 2: Japanese Unexamined Patent Application Publication No. 9-126190 (p. 3 and FIG. 1)

Patent Literature 3: Japanese Patent No. 2669448 (pp. 3 to 4 and FIG. 1)

SUMMARY OF INVENTION

Technical Problem

However, the turbofan disclosed by Patent Literature 1 has the following problem. Since the turbofan has "saw-tooth-shaped" cuts in the rear-edge portion of each blade, the length of the blade chord alternately increases and decreases. Therefore, the airflow concentrates on positions of the saw-tooth-shaped portion where the chord length is short. Hence, the area of the blade is substantially smaller than a blade having no saw-tooth-shaped cuts, and the air-sending efficiency is reduced. Therefore, the rotation speed of the fan needs to be increased so that a required amount of air is sent. As a result, the friction between the airflow and the wall of the blade increases, disturbing the airflow. Consequently, noise is generated (the noise becomes louder).

The turbofan disclosed by Patent Literature 2 has the following problem. Each blade of the turbofan has, on the rear edge portion of the front surface (positive-pressure surface) thereof in the direction of rotation, a plurality of "ribs" provided parallel to one another at predetermined intervals and extending in the direction perpendicular to the rotating shaft. Therefore, the airflow on the positive-pressure surface of the blade collides with the ribs or goes over the ribs and is thus separated significantly. Consequently, shed vortices grow larger, and noise is generated (the noise becomes louder).

The turbofan disclosed by Patent Literature 3 has the following problem. Each blade has, over the entirety or a portion of the front surface (positive-pressure surface) thereof in the direction of rotation, "riblets" in the form of fine grooves extending in a direction orthogonal to the rotating shaft. Therefore, the air flows along the riblets on the positive-pressure surface of the blade, whereas shear turbulence occurs at the rear-edge portion of the blade, i.e., the tip of the blade on the outer circumferential side, because the positive-pressure surface and the negative-pressure surface of the blade meet each other (the surfaces share the rear edge of the blade) producing a difference in speed between the airflow along the positive-pressure surface of the blade and the airflow along the negative-pressure surface of the blade. Consequently, shed vortices grow larger, and noise is generated (the noise becomes louder).

There is another problem in a case where the riblets are provided over the entirety of the positive-pressure surface of the blade. In an area around a front edge portion of the blade that is near the shroud, the air taken in does not flow along the riblets. Therefore, flow separation occurs in the foregoing area, and noise is generated (the noise becomes louder).

The present invention is to solve the above problems and to provide a turbofan whose blades each have a sufficient area and that generates less noise, and an indoor unit of an air-conditioning apparatus including the turbofan.

Solution to Problem

A turbofan according to the present invention includes a disc-shaped main plate having a boss projecting in a predetermined region containing a center of rotation; a ring-shaped shroud facing the main plate; and a plurality of blades each having two ends thereof joined to the main plate and the shroud, respectively.

A blade rear edge of each of the blades resides on a virtual cylinder defined by an outer circumference of the disc and an outer circumference of the shroud. A blade front edge of the blade resides at a position nearer to the center of rotation than the blade rear edge. A virtual line connecting the blade rear edge and the blade front edge is angled with respect to a radial line extending from the center of rotation.

A blade outer-circumferential surface that is a surface of the blade farther from the center of rotation has a plurality of rear-edge horizontal grooves having predetermined lengths reaching the blade rear edge.

The rear-edge horizontal grooves extend perpendicularly to the center of rotation and wrap around an end of the blade rear edge to a blade inner-circumferential surface that is a surface of the blade nearer to the center of rotation.

Advantageous Effects of Invention

In the turbofan according to the present invention, the blade rear-edge portion of the blade outer-circumferential surface, which is a blade positive-pressure surface, has a plurality of rear-edge horizontal grooves extending orthogonally to the center of rotation and having predetermined lengths. The rear-edge horizontal grooves wrap around to the blade inner-circumferential surface, which is a blade negative-pressure surface. Therefore, the following advantageous effects are produced.

(a) Some of the air flowing from the blade rear-edge portion of the blade positive-pressure surface to the blade rear-edge end flows into the plurality of rear-edge horizontal grooves while the other flows along surfaces of the blade rear-edge portion (surfaces extending between adjacent ones of the rear-edge horizontal grooves) to the end of the blade rear edge. Therefore, although the rear-edge horizontal grooves are provided, the reduction in the area of the blade is very small and any factors that may reduce the air-sending efficiency are suppressed.

(b) Air flows into the rear-edge horizontal grooves. Therefore, the growth of boundary layers on the blade positive-pressure surface is suppressed.

(c) Some of the air flowing on the side of the blade positive-pressure surface is supplied to the side of the blade negative-pressure surface, on which the boundary layers gradually grow from the inner circumferential side of an impeller toward the outer circumferential side, (from the windward side toward the leeward side) via groove wrapping portions. This prevents the occurrence of separation of airflow on the blade negative-pressure surface and suppresses the occurrence of shear turbulence due to the difference between the speeds of airflow produced on the blade negative-pressure surface and the blade positive-pressure surface.

(d) Hence, shed vortices become small. The shed vortices which have been small are diffused. Thus, the noise generated by the turbofan is reduced.

(e) If a heat exchanger is provided on the downstream side in an air-blowing direction of the turbofan, the air having suppressed shed vortices flows into the heat exchanger. Therefore, the noise generated at the heat exchanger is reduced.

(f) If a rectangular heat exchanger is provided in such a manner as to surround the turbofan, the draft resistance is relatively small when the blade rear-edge ends are positioned near the corners of the heat exchanger (when the blade rear-edge ends are positioned relatively far from the heat exchanger) and is relatively large when the blade rear-edge ends are positioned near the centers of the sides of the heat exchanger (when the blade rear-edge ends are positioned relatively near the heat exchanger). Thus, the draft resistance causes pulsation phenomenon.

However, while the draft resistance is gradually increasing (while the blade rear-end edges are getting closer to the centers of the sides), some of the air flows into the rear-edge horizontal grooves, whereby the flow of air is straightened. Therefore, separation of airflow does not tend to occur. Meanwhile, while the draft resistance is gradually decreasing (while the blade rear-end edges are getting closer to the corners), an airflow is produced along the blade surface. Therefore, separation of airflow does not tend to occur. Thus, even if there are changes in draft resistance, the occurrence of separation of airflow is reduced. Consequently, the noise is reduced.

(g) The presence of the plurality of rear-edge horizontal grooves lightens each blade (a material forming the blade). Thus, weight reduction is realized.

DESCRIPTION OF EMBODIMENTS

Embodiment 1

Indoor Unit of Air-Conditioning Apparatus

Figure 1:
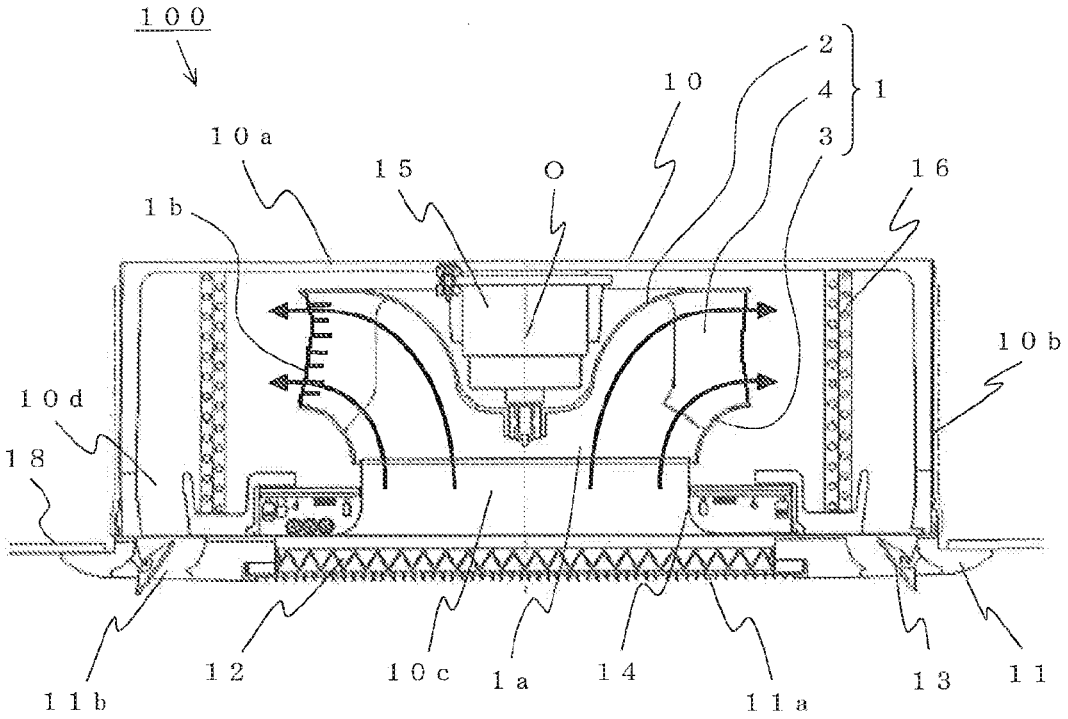
FIG. 1 is a vertical sectional view of an indoor unit of an air-conditioning apparatus according to Embodiment 1 of the present invention.
Figure 2:
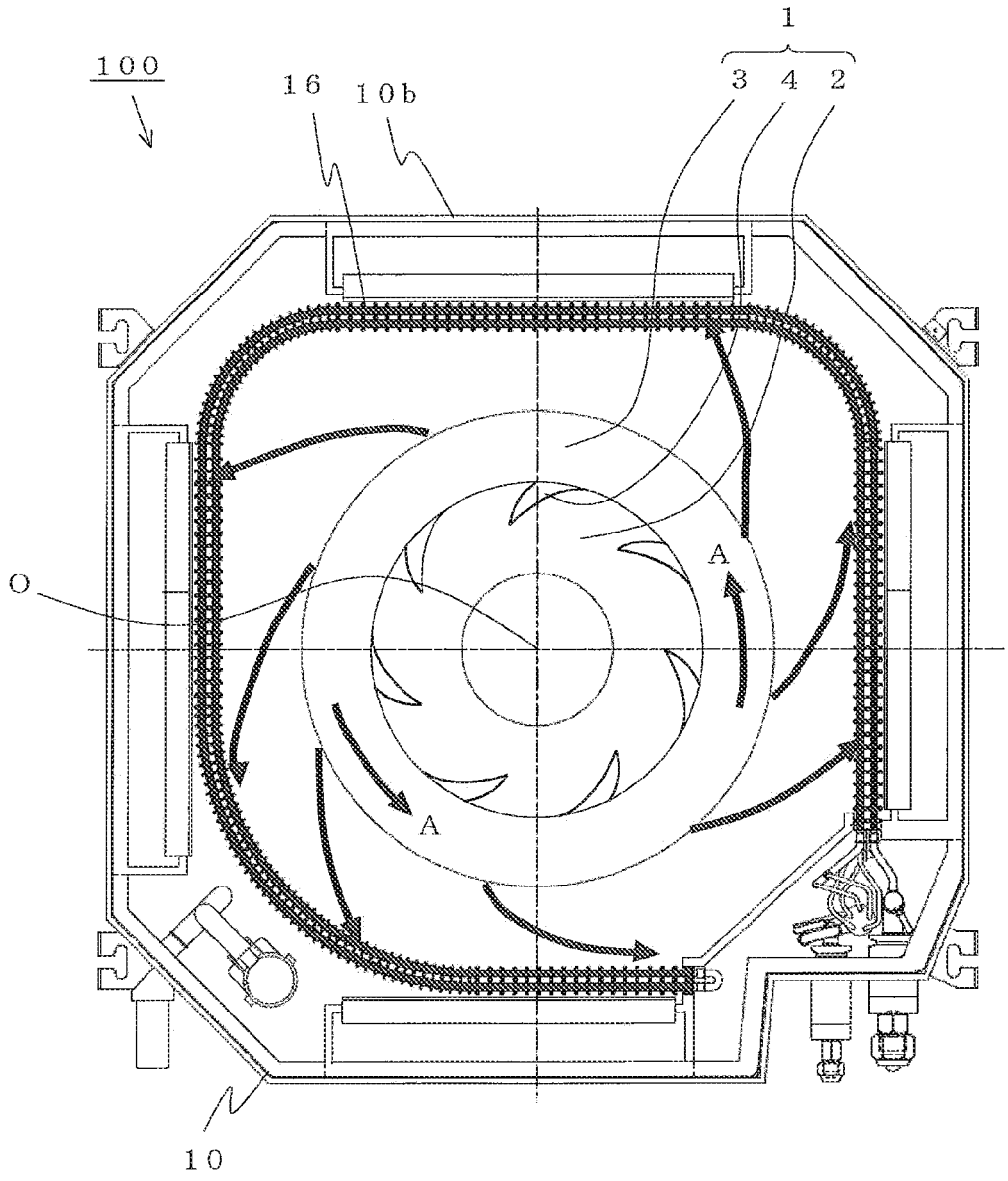
FIG. 2 is a horizontal sectional view of the indoor unit of an air-conditioning apparatus according to Embodiment 1 of the present invention.

FIGS. 1 and 2 illustrate an indoor unit of an air-conditioning apparatus according to Embodiment 1 of the present invention. FIG. 1 is a schematic vertical sectional view. FIG. 2 is a schematic horizontal sectional view.

While the present Embodiment relates to an exemplary case of a ceiling-concealed air-conditioning apparatus, the present invention is not limited thereto and may be widely applicable to indoor units of air-conditioning apparatuses including turbofans provided with pressure loss members that allow air to flow therethrough, such as filters and heat exchangers, at the air inlet side and the air outlet side of the fans.

Referring to FIG. 1, an indoor unit of an air-conditioning apparatus (hereinafter simply referred to as "indoor unit" also) 100 is housed in a recess provided in a ceiling 18 of a room. A body 10 is a casing including a rectangular top board 10*a* and a side board 10*b* standing from the circumference of the top board 10*a*. A side of the body 10 opposite the top board 10*a* is open, with a decorative panel 11 provided over the side having the opening.

That is, the indoor unit 100 is provided in the ceiling 18 in such an orientation that the top board 10*a* resides on the upper side and the decorative panel 11 resides on the lower side. In this state, the lower surface of the decorative panel 11 faces (is exposed in) the room while slightly projecting from the lower surface (a surface facing the room) of the ceiling 18.

The decorative panel 11 has near the center thereof an air inlet grille 11*a* through which air is taken into the body 10, a filter 12 that catches dust included in the air having passed through the air inlet grille 11*a*, and panel fan-air outlets 11*b* provided along respective sides of the decorative panel 11. The panel fan-air outlets 11*b* are provided with respective air-directing vanes 13 that change the direction of the air that is blown out.

A fan motor 15 is provided on the top board 10*a*. A turbofan 1 is fixed to the rotating shaft of the fan motor 15. A bellmouth 14 that defines an intake air path extending from the air inlet grille 11*a* to the turbofan 1 is interposed between the filter 12 and the turbofan 1.

A heat exchanger 16 having a substantially quadrilateral shape in plan view is provided around the outer circumference of the turbofan 1. The heat exchanger 16 is connected to an outdoor unit with a non-illustrated connection pipe.

In the indoor unit 100 configured as described above, when the turbofan 1 is rotated, air in the room 17 is taken in through the air inlet grille 11*a* provided in the decorative panel 11 and passes through the filter 12, where dust is caught, into the bellmouth 14 provided in a body intake-air path 10*c*. After passing through the bellmouth 14, the air is taken into the turbofan 1 substantially upward (substantially parallel to the rotating shaft of the fan motor 15).

Subsequently, the air is blown from the turbofan 1 toward the heat exchanger 16 in a substantially horizontal direction (a direction substantially perpendicular to the rotating shaft of the fan motor 15). The air that has been subjected to heat exchange for heating or cooling or has been dehumidified in the heat exchanger 16 (i.e., the conditioned air) passes through a body outflow-air path 10*d* and the panel fan-air outlets 11*b* and is blown out to the room 17 while the direction thereof is controlled by the air-directing vanes 13.

The turbofan 1 will be described in detail in Embodiment 2.

Embodiment 2

Turbofan

Figure 3:
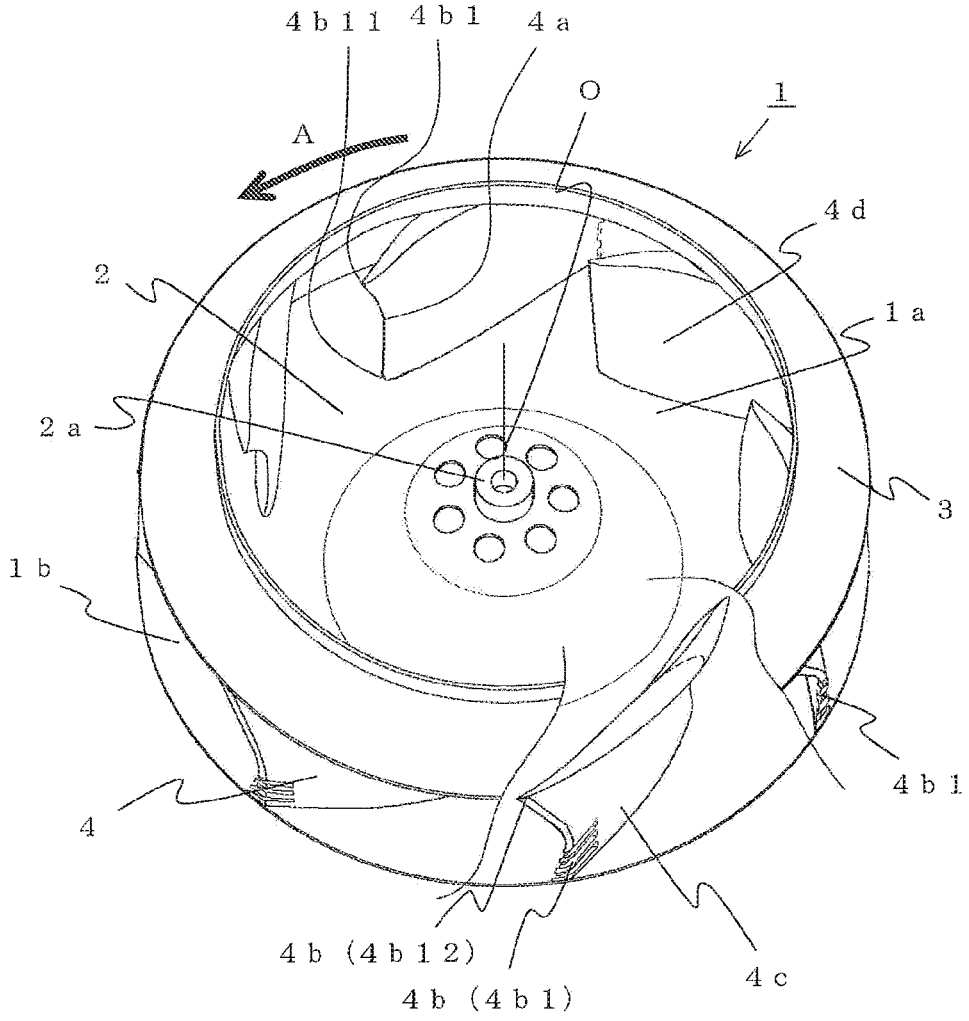
FIG. 3 is a perspective view of a turbofan according to Embodiment 2 of the present invention.
Figure 4:
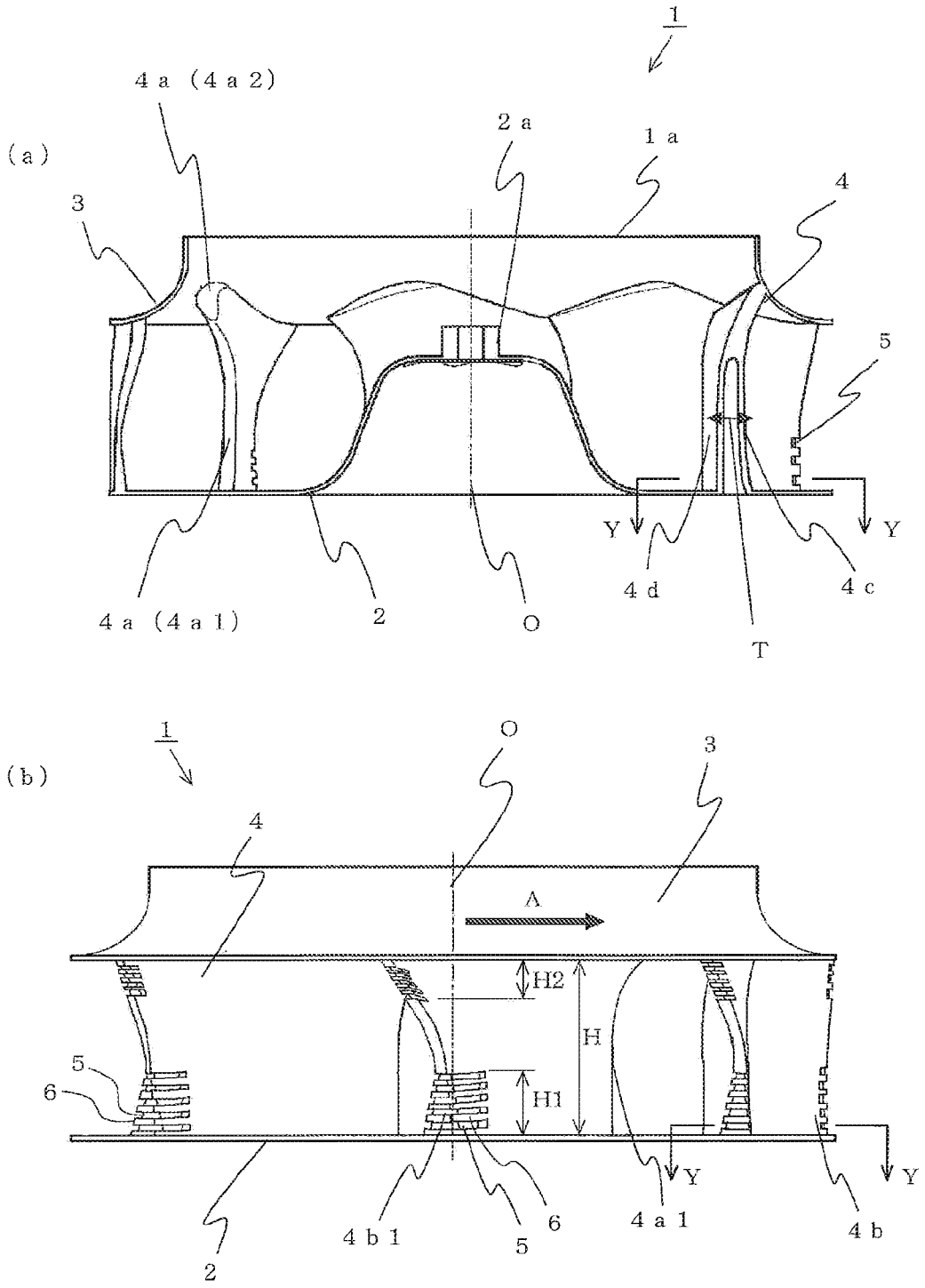
FIG. 4 includes a schematic vertical sectional view and a schematic side view of the turbofan illustrated in FIG. 3.
Figure 5:
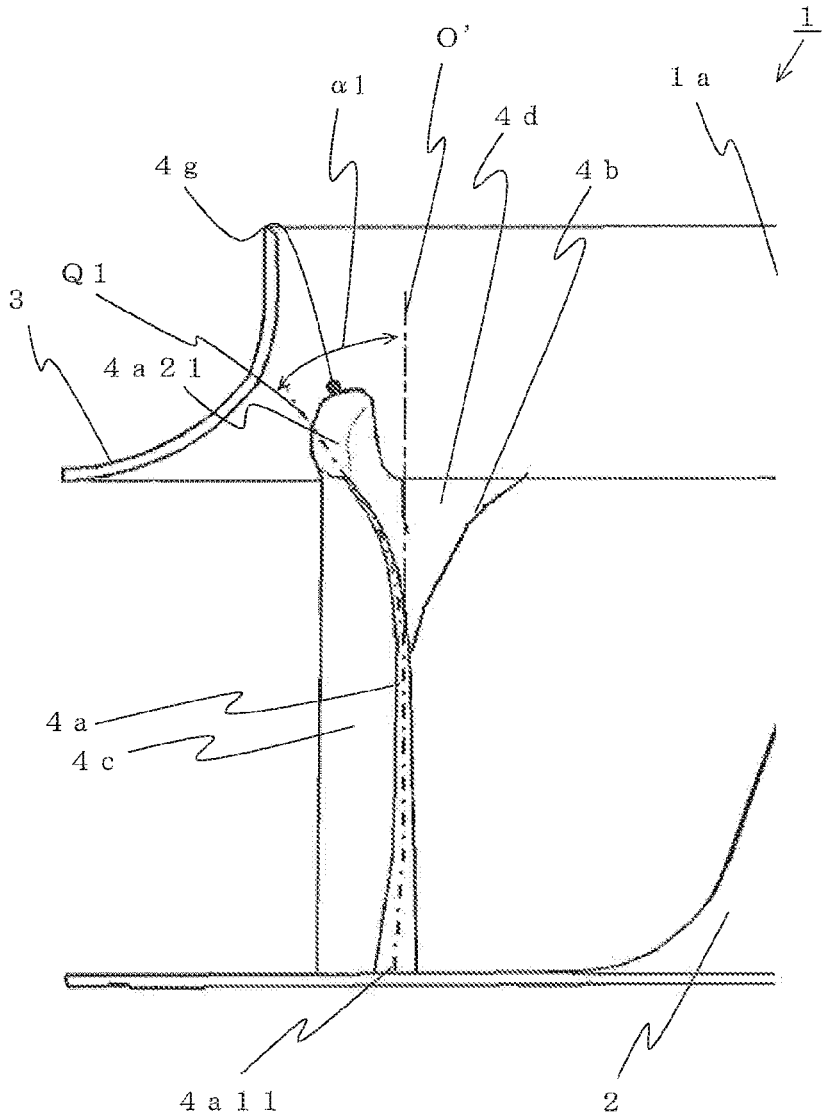
FIG. 5 is an enlarged side view illustrating a front edge portion of a blade of the turbofan illustrated in FIG. 3.
Figure 6:
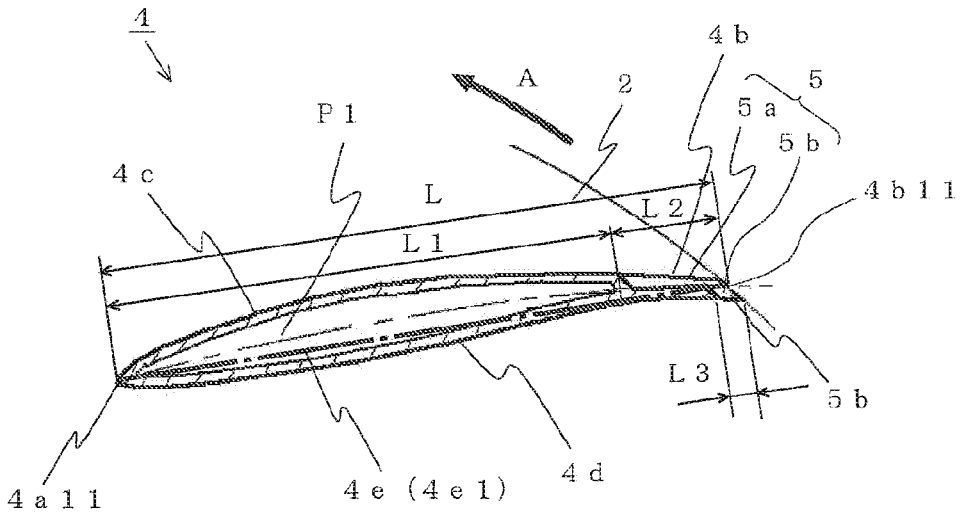
FIG. 6 is an enlarged horizontal sectional view illustrating the blade of the turbofan illustrated in FIG. 3.
Figure 7:
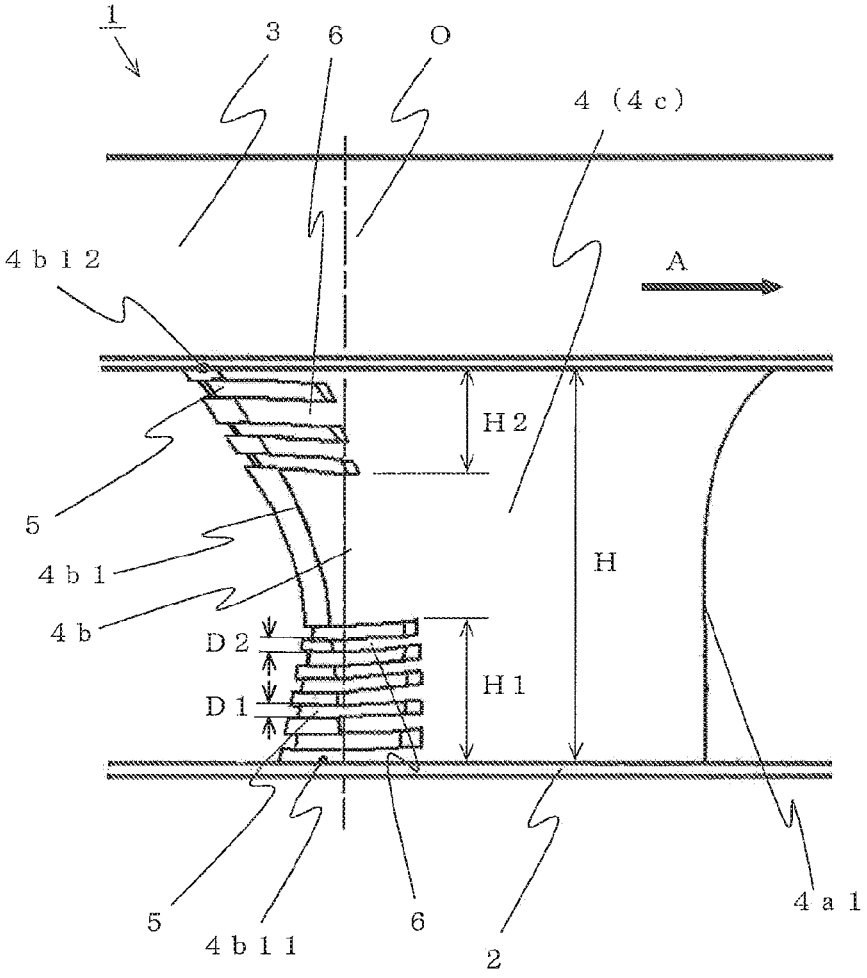
FIG. 7 is an enlarged side view illustrating a rear edge portion of the blade of the turbofan illustrated in FIG. 3.
Figure 8:
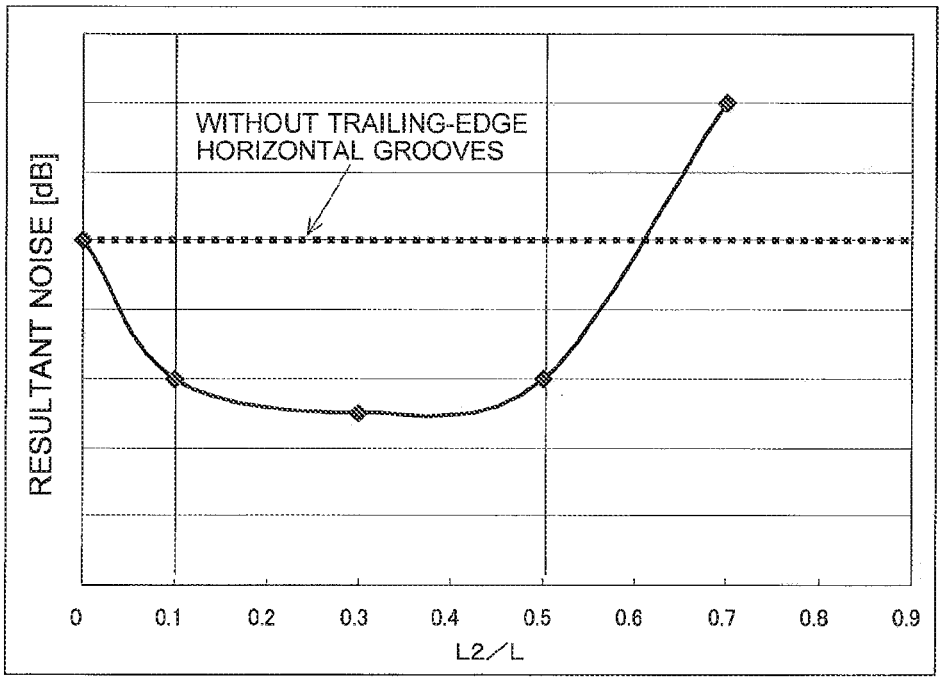
FIG. 8 is a performance chart illustrating the relationship between the shape of rear-edge horizontal grooves illustrated in FIG. 6 and the resultant noise.
Figure 9:
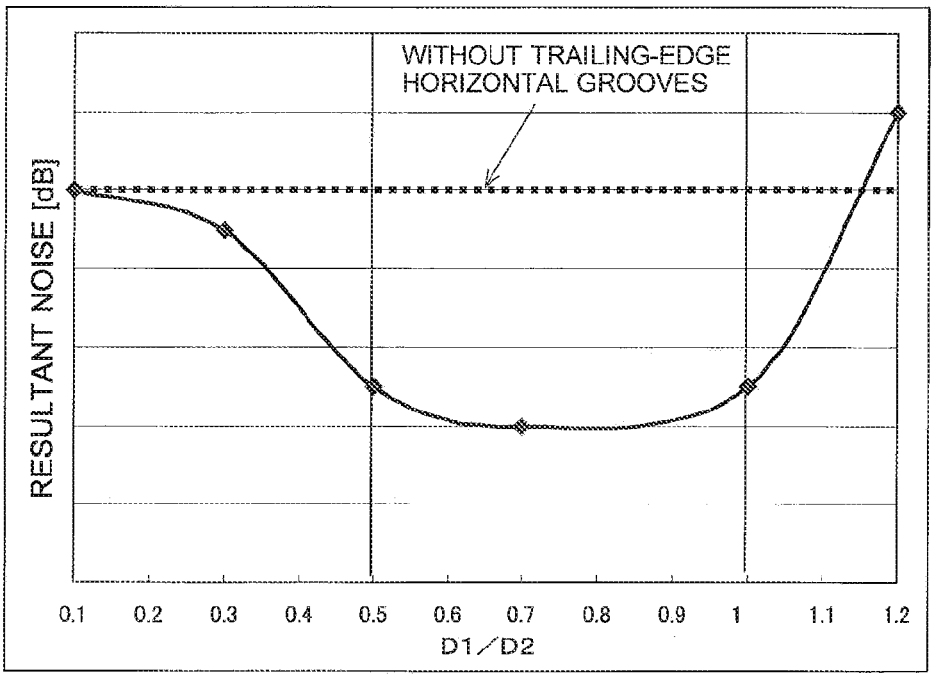
FIG. 9 includes other performance charts each illustrating the relationship between the shape of the rear-edge horizontal grooves illustrated in FIG. 6 and the resultant noise.
Figure 9:
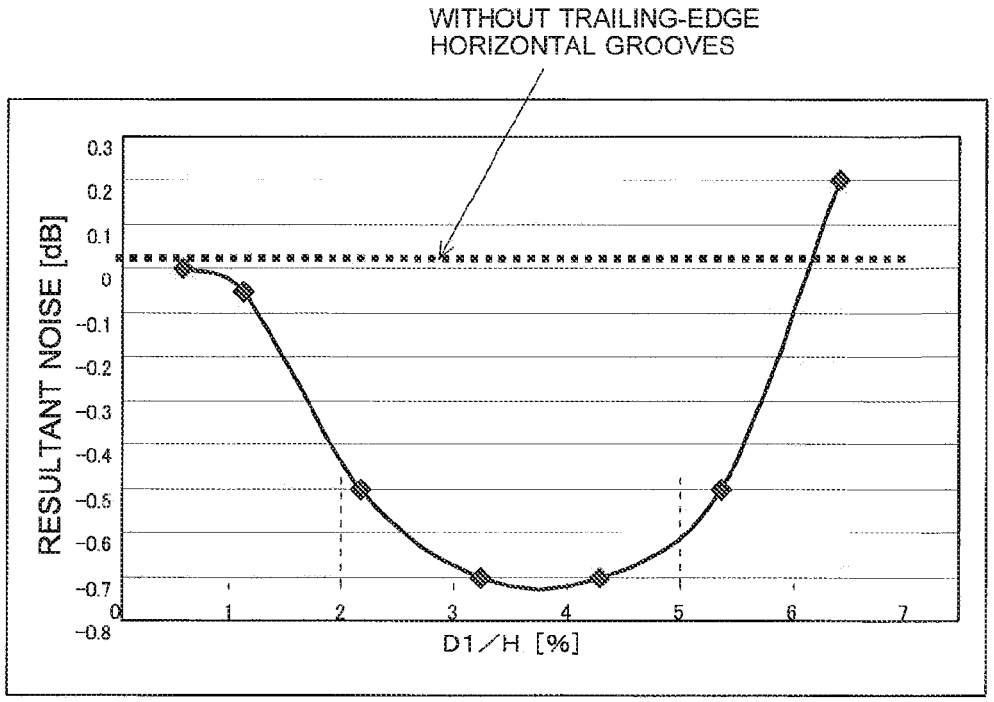
Figure 10:
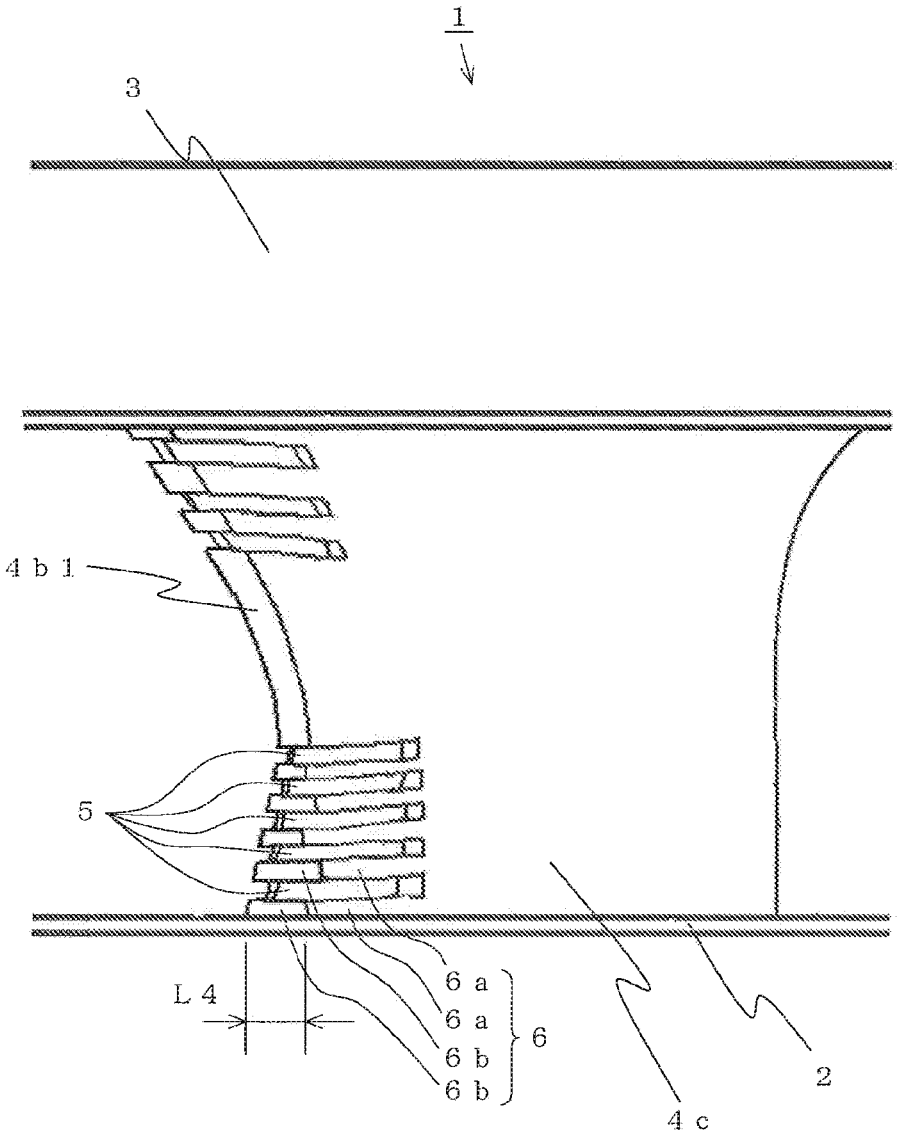
FIG. 10 is a schematic side view illustrating a modification of the rear-edge horizontal grooves illustrated in FIG. 6.
Figure 11:
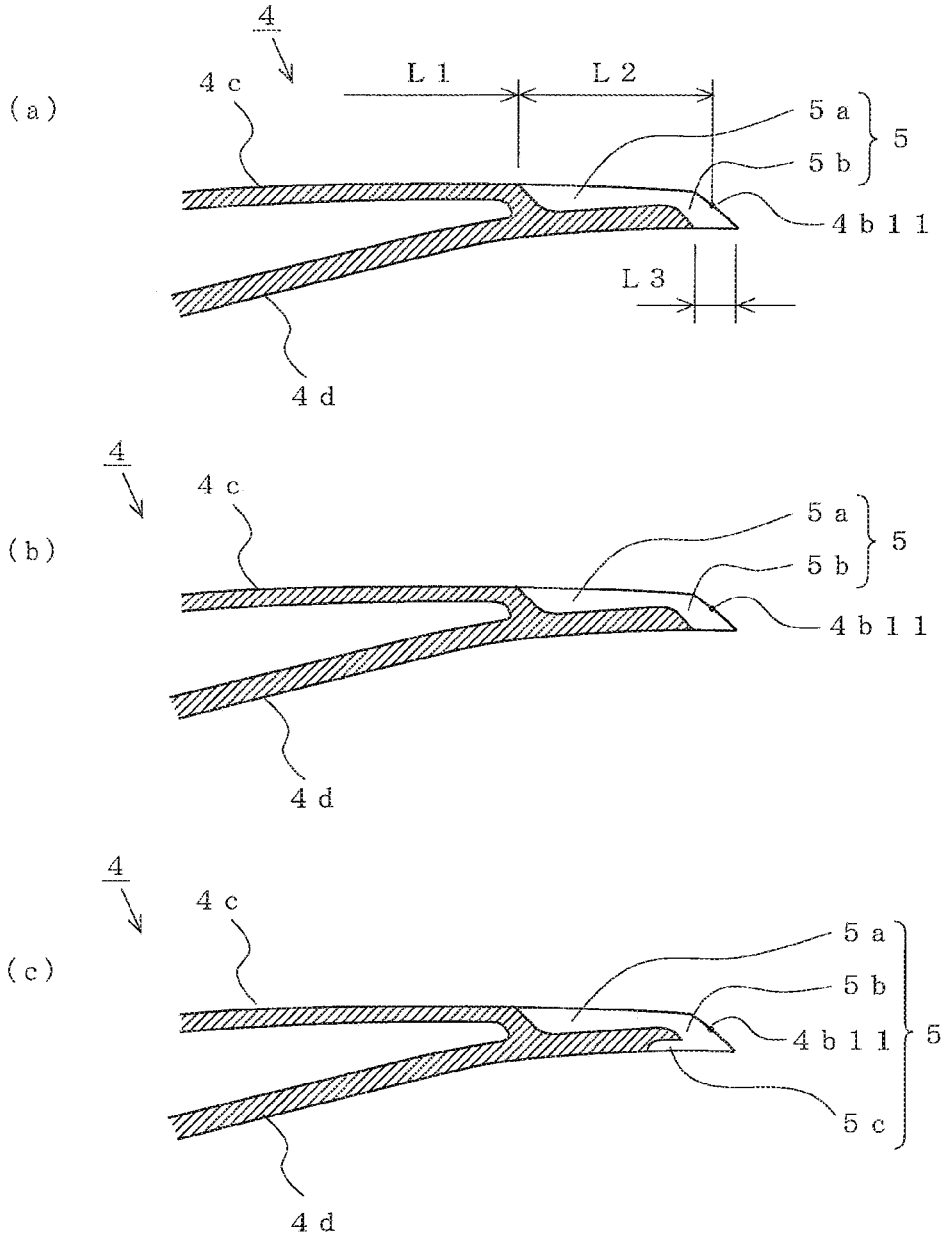
FIG. 11 includes schematic vertical sectional views illustrating other modifications of the rear-edge horizontal grooves illustrated in FIG. 6.

FIGS. 3 to 11 illustrate a turbofan according to Embodiment 2 of the present invention. FIG. 3 is a schematic perspective view. FIG. 4 includes a schematic vertical sectional view and a schematic side view. FIG. 5 is an enlarged side view of a part (a blade front-edge portion). FIG. 6 is an enlarged horizontal sectional view of a part (a blade). FIG. 7 is an enlarged side view of a part (a blade rear-edge portion). FIGS. 8 and 9 are performance charts each illustrating the relationship between the shape of a part (rear-edge horizontal grooves) and the resultant noise. FIG. 10 is a schematic side view illustrating a modification of a part (the rear-edge horizontal grooves). FIG. 11 includes schematic vertical sectional views illustrating other modifications of the part (the rear-edge horizontal grooves).

In the drawings, the same or corresponding elements are denoted by the same reference numerals, and some description thereof is omitted.

As a matter of descriptive convenience, FIGS. 3 to 7 and 10 illustrate the turbofan in such an orientation that air is taken in from the upper side of the page toward the lower side thereof and is blown out in a substantially horizontal direction against the page; that is, the turbofan is oriented upside down compared with the orientation of the turbofan 1, illustrated in FIG. 1 (Embodiment 1), installed in the indoor unit 100.

Referring to FIGS. 3 and 4, the turbofan 1 includes a substantially disc-shaped main plate 2 having a central portion thereof projecting in a mound shape, a substantially ring-shaped shroud 3 facing the main plate 2, and a plurality of blades 4 joined to the main plate 2 and the shroud 3.

The shroud 3 has a substantially trumpet shape (a ring-shaped body having a substantially arc shape in sectional view). The center opening of the shroud 3 serves as a fan air inlet 1*a*. Thus, the shroud 3 provides an intake-air guide wall.

The main plate 2 is integrally provided with a boss 2*a* at the top of the central projecting portion thereof. The boss 2*a* serves as a fixing portion to which the rotating shaft of the fan motor 15 is fixed. Hereinafter, the center of the rotating shaft is referred to as "center of rotation O".

The blades 4 each have a tapered shape in which a thickness T thereof (the distance between a blade outer-circumferential surface (blade positive-pressure surface) and a blade inner-circumferential surface (blade negative-pressure surface) in a horizontal section taken in a direction orthogonal to the rotating shaft) decreases in the height direction from the main plate 2 toward the shroud 3. Each blade 4 has a hollow structure with a cavity provided therein. The cavity communicates with an opening provided in the main plate 2 and is open at the lower surface of the main plate 2 (to the outside of an impeller).

An area enclosed by each pair of adjacent blades 4, the shroud 3, and the main plate 2 serves as an airflow path. The outer circumferential end of the airflow path serves as a fan air outlet 1*b*.

Blade Front-Edge Portion

Referring to FIGS. 5 to 7, a blade front-edge portion 4*a* of the blade 4 is configured as follows. A portion of the blade outer-circumferential surface (corresponding to the blade positive-pressure surface) 4*c* nearer to the main plate 2 stands substantially vertical to the main plate 2. A portion of the blade outer-circumferential surface 4*c* nearer to the shroud 3 is gradually angled away from the center of rotation O while extending toward the shroud 3 (the portion is curved outward in the radial direction while extending upward). The blade inner-circumferential surface (corresponding to the blade negative-pressure surface) 4*d* is generally curved (bent) outward in the radial direction over the entirety thereof in the height direction from the main plate 2 to the shroud 3, the curve being more significant than that of the blade outer-circumferential surface 4*c*.

Herein, a region of the blade front-edge portion 4*a* on the side of the blade inner-circumferential surface (corresponding to the blade negative-pressure surface) 4*d* is referred to as "blade front-edge end 4*a*1", and a line extending in the height direction in such a manner as to trace the center of thickness of the blade front-edge end 4*a*1 is referred to as "vertical camber line Q1".

In a plane containing the vertical camber line Q1, the angle formed between the vertical camber line Q1 and the center of rotation O (corresponding to a virtual line O' defined in the foregoing plane and being parallel to the center of rotation O) is referred to as "angle of bend $\alpha$1 at the blade front-edge end 4*a*1".

The joint between the blade 4 and the shroud 3 on the inner circumferential side (a point from which the blade 4 starts to be spaced apart from the shroud 3) is referred to as "blade shroud-side joint 4*g*". In a section passing through the blade shroud-side joint 4*g*, a line extending in the height direction in such a manner as to trace the center of thickness is referred to as "vertical camber line Q2 (not illustrated)".

In a plane containing the vertical camber line Q2, the angle formed between the vertical camber line Q2 and the center of rotation O (corresponding to the virtual line O' provided in the foregoing plane and being parallel to the center of rotation O) is referred to as "angle of bend $\alpha$2 at the blade shroud-side joint 4*g*".

In this case, the "angle of bend $\alpha$2 at the blade shroud-side joint 4*g*" is smaller than the "angle of bend $\alpha$1 at the blade front-edge end 4*a*1". Furthermore, the angles of bend $\alpha$ gradually increase toward the center of the impeller (the center of rotation O). Furthermore, a blade shroud-side front edge portion 4*a*2 bends toward the outer side of the turbofan 1 (in a direction away from the center of rotation O) while extending toward the center.

In the turbofan 1 configured as described above, the blade front-edge end 4*a*1 (an end where the blade outer-circumferential surface (blade positive-pressure surface) 4*c* and the blade inner-circumferential surface (blade negative-pressure surface) 4*d* meet each other) bends toward the outer side of the impeller (in the direction away from the center of rotation O) while extending from the main plate 2 toward the shroud 3. Therefore, the induction of air to be taken in is promoted, whereby the occurrence of flow separation due to impact at the air inlet is suppressed. That is, the airflow produced in the vertical direction (substantially parallel to the center of rotation O) in the body intake-air path 10*c* can be smoothly redirected radially toward the fan air-outlet 1*b* in a substantially horizontal direction (substantially perpendicularly to the center of rotation O) without being separated. Consequently, the turbofan 1 generates less noise. Hence, the indoor unit 100 including the turbofan 1 operates quietly and provides improved comfort.

Sectional Shape of Blade

The sectional shape of the blade 4 will now be described on the basis of the following definitions. In a horizontal section taken near the joint between the rear-edge-portion blade 4 and the main plate 2 (corresponding to a section taken at cut position Y-Y illustrated in FIG. 4), a line extending in such a manner as to trace the center of thickness is referred to as "horizontal camber line P1". The intersection of the horizontal camber line P1 and the blade front-edge end 4*a*1 is referred to as "main-plate-side end point 4*a*11 of the blade-inner-circumferential-side front-edge portion". The intersection of the horizontal camber line P1 and the blade rear-edge portion 4*b* is referred to as "main-plate-side end point 4*b*11 of the blade rear-edge portion". A line connecting the main-plate-side end point 4*a*11 of the blade-inner-circumferential-side front-edge portion and the main-plate-side end point 4*b*11 of the blade rear-edge portion is referred to as "main-plate-side blade chord 4*e*1" (see FIG. 6).

Blade Rear-Edge Portion

The blade outer-circumferential surface 4*c* of the blade 4 has a plurality of rear-edge horizontal grooves 5 extending in the horizontal direction (in a plane perpendicular to the center of rotation O) and having a predetermined length L2 reaching the blade rear-edge portion 4*b*. The rear-edge horizontal grooves 5 wrap around groove wrapping portions 5*b*, which is provided at the terminal end of the blade rear-edge portion 4*b*, to the blade inner-circumferential surface 4*d*.

That is, the rear-edge horizontal grooves 5 are each a combination of a groove portion (a recessed portion, hereinafter referred to as "groove recessed portion") 5*a* provided with a predetermined depth in the blade outer-circumferential surface 4*c* and the groove wrapping portion 5*b*. Accordingly, the bottom of the groove recessed portion 5*a* resides near the blade inner-circumferential surface 4*d*. Therefore, the thickness of the blade 4 at the groove recessed portion 5*a* is small (see FIG. 6).

Here, as a matter of convenience in the following description, the length of the main-plate-side blade chord 4*e*1 is referred to as main-plate-side blade chord L, the length of the rear-edge horizontal groove 5 is denoted by L2, and the distance on the blade outer-circumferential surface 4*c* from the main-plate-side end point 4*a*11 of the blade-inner-circumferential-side front-edge portion to a point from which the rear-edge horizontal groove 5 starts to extend (strictly, the linear distance in a direction parallel to the main-plate-side blade chord 4*e*1) is denoted by L1. Then, "L=L1+L2" holds. In addition, the length of the groove wrapping portion 5*b* is denoted by L3.

FIG. 6 illustrates one of the rear-edge horizontal grooves 5 that is nearest to the main plate 2 in the height direction. There are other plurality of rear-edge horizontal grooves 5 provided at positions farther from the main plate 2 in the height direction and extending parallel to one another (see FIGS. 4 and 7).

That is, letting the distance between the main plate 2 and the shroud 3 in the blade rear-edge portion 4*b* be referred to as blade rear-edge height (hereinafter referred to as "fan air-outlet height") H, the rear-edge horizontal grooves 5 are provided in a region of the blade rear-edge portion 4*b* extending upward from the main plate 2 to a position defined by a distance H1 and in a region of the blade rear-edge portion 4*b* extending downward from the shroud 3 to a position defined by a distance H2.

If the distance H2 defining the region nearer to the shroud 3 where the rear-edge horizontal grooves 5 are provided is set to half the fan air-outlet height H or smaller (0 to 50%), the following effects are produced.

Then, here, as a matter of convenience in the following description, the height of the rear-edge horizontal groove 5 (corresponding to the width of the groove recessed portion 5*a* in the height direction) is referred to as groove width D1, and the width, in the height direction, of an inter-groove surface portion 6 extending between adjacent ones of the groove recessed portions 5*a* is referred to as groove interval D2.

In a horizontal plane at each of different positions in the height direction, an edge nearer to the center of rotation O where the blade outer-circumferential surface 4*c* and the blade inner-circumferential surface 4*d* meet is referred to as "blade front-edge end 4*a*1", an edge farther from the center of rotation O is referred to as "blade rear-edge end 4*b*1", and a line connecting the two is referred to as "blade chord 4*e*". For the rear-edge horizontal grooves 5 provided at respective positions in the height direction, the length of the blade chord 4*e* is also denoted by "L" (actually, the length of the blade chord 4*e* is not necessarily uniform and may vary with the position in the height direction).

As described above, the plurality of rear-edge horizontal grooves 5 provided in the blade rear-edge portion 4*b* of the turbofan 1 each include the groove recessed portion 5*a* provided in the blade outer-circumferential surface (blade positive-pressure surface) 4*c* and extending in the horizontal direction and the groove wrapping portion 5*b* connecting the blade outer-circumferential surface (blade positive-pressure surface) 4*c* and the blade inner-circumferential surface (blade negative-pressure surface) 4*d* to each other at the end point of the blade rear-edge portion 4*b*.

Hence, unlike the background art employing a saw-tooth-shaped blade (see Patent Literature 1), the area of the blade is not reduced. Furthermore, since the air flows into the groove recessed portion 5*a*, the speed of the airflow is increased and the airflow is straightened.

Moreover, since the blade positive-pressure side and the blade negative-pressure side are connected to each other at the groove wrapping portion 5*b*, the airflow is diffused with changes in the draft resistance. Consequently, separation of airflow does not tend to occur, leading to noise reduction.

Specifically, the airflow along the blade outer-circumferential surface 4*c* is induced into the groove recessed portion 5*a* provided on the side of the blade outer-circumferential surface 4*c* nearer to the blade rear-edge portion 4*b*, whereby the occurrence of separation of airflow is suppressed. In this case, there is a difference between the speed of the airflow having passed through the groove recessed portion 5*a* and the speed of airflow along the inter-groove surface portion 6 (blade outer-circumferential surface 4*c*) extending between adjacent ones of the groove recessed portions 5*a*. Therefore, the flow of air that is shed from the rear-edge-end portion of the groove recessed portion 5*a* toward the outer side (shed vortices at the rear edge) and the flow of air that is shed from the rear-edge-end portion of the blade outer-circumferential surface 4*c* toward the outer side (shed vortices at the rear edge) interfere with each other and are each broken. Consequently, strongly turbulent shed vortices are not produced. Accordingly, the noise is reduced.

In particular, when air flows from the fan air inlet 1*a* of the turbofan 1 toward the fan air outlet 1*b* along the curved surface of the shroud 3, the airflow may not be redirected sufficiently and may be separated slightly on a side of the fan air outlet 1*b* nearer to the shroud 3. Even in such a case, the rear-edge horizontal grooves 5 straighten the airflow. Thus, the occurrence of flow separation is suppressed, and the noise is reduced.

As illustrated in FIG. 7, the "main-plate-side end point 4*b*11 of the blade rear-edge portion" where the blade rear-edge portion 4*b* and the main plate 2 are joined to each other resides at, in a direction of rotation A, a position ahead of a "shroud-side end point 4*b*12 of the blade rear-edge portion" where the blade rear-edge portion 4*b* and the shroud 3 are joined to each other.

Therefore, some of the air is induced toward the shroud 3, whereby the distribution of wind speed tends to become uniform in the height direction at the fan air outlet 1*b*. Meanwhile, the presence of the rear-edge horizontal grooves 5 allows the air to smoothly flow in the radial direction and thus suppresses the deflection of airflow toward the shroud 3. Hence, the airflow becomes more uniform and is less affected by changes in draft resistance, leading to a further noise reduction.

Consequently, the turbofan 1 and the indoor unit 100 generate very low noise with less change in the noise level that may be caused by turbulence.

Performance Characteristics

Referring to FIG. 8, the horizontal axis represents the ratio of the length L2 of the rear-edge horizontal groove 5 to the main-plate-side blade chord L (L2/L), and the vertical axis represents the ratio of the noise generated by the turbofan 1 having the rear-edge horizontal grooves 5 to the noise generated by a turbofan having no rear-edge horizontal grooves 5 (hereinafter referred to as "resultant noise").

When the length L2 of the rear-edge horizontal groove 5 is long (L2≥0.5×L), the increase in the static pressure applied to the blade outer-circumferential surface 4*c* is small. Therefore, the air-sending efficiency is reduced. Accordingly, the rotation speed of the fan needs to be increased so that a required amount of air is sent. As a result, the wall friction of the blade increases, disturbing the airflow. Consequently, noise is generated (the noise becomes louder).

In contrast, when the length L2 of the rear-edge horizontal groove 5 is short (L2≤0.1), the groove recessed portion 5*a* is also short. Therefore, the degree of the above-described effects (straightening of airflow and prevention of flow separation) is low.

Hence, the length L2 of the rear-edge horizontal groove 5 is preferably set to 10% to 50% of the blade chord length L (0.1×L≤L2≤0.5×L). Thus, the turbofan 1 and the indoor unit 100 generate much less noise without reduction in the air-sending efficiency.

Referring to FIG. 9(*a*), the horizontal axis represents the ratio of groove width D1 of the rear-edge horizontal groove 5 to the groove interval D2 (D1/D2), and the vertical axis represents the resultant noise.

When the groove width D1 of the rear-edge horizontal groove 5 is larger than the groove interval D2 (D1/D2≥1.0), a large amount of air flows into the groove recessed portion 5*a* and the amount of air flowing along the inter-groove surface portion 6 is reduced. Therefore, the airflow in the other area along the blade outer-circumferential surface 4*c* becomes unstable.

In contrast, when the groove width D1 is smaller than the groove interval D2 (D1/D2≤0.2), the amount of air flowing into the rear-edge horizontal groove 5 is too small and the airflow around the blade rear-edge portion 4*b* of the blade is not diffused sufficiently. Consequently, shed vortices grow larger at the rear edge, increasing the noise.

Hence, the groove width D1 and the groove interval D2 preferably satisfy at least a relationship of "0.5×D2≤D1≤1.0×D2". Thus, the turbofan 1 and the indoor unit 100 generate less noise.

Referring to FIG. 9(*b*), the horizontal axis represents the ratio of the groove width D1 to the fan height H (D1/H), and the vertical axis represents the resultant noise. Specifically, when the ratio (D1/H) is too small, the resultant noise increases (the resultant noise becomes a large positive value) because air does not flow into the rear-edge horizontal groove 5. In contrast, when the ratio (D1/H) is too large, noise is generated because an excessive amount of air flows into the rear-edge horizontal groove 5 and the effect of straightening the airflow is eliminated. This means that there is an optimum range for the relationship between the groove width D1 and the fan air-outlet height H. Specifically, as illustrated in FIG. 9(*b*), the ratio (D1/H) is preferably set to "2 to 5%".

Modifications of Rear-Edge Horizontal Grooves

Referring to FIG. 10, the inter-groove surface portions 6 each include an inter-groove continuous surface 6*a* that is continuous with the blade outer-circumferential surface 4*c*, and an inter-groove projection 6*b* that is provided in a predetermined region near the end of the blade rear-edge portion 4*b* and that projects toward the outer circumferential side. One of the inter-groove projections 6*b* of the inter-groove surface portions 6 that is provided at a certain height has a length L4 that is different from lengths L4 of other inter-groove projections 6*b* of the inter-groove surface portions 6 that are adjacent thereto in the vertical direction. That is, the inter-groove projections 6*b* extend from staggered positions in side view.

Therefore, in the blade rear-edge portion 4*b*, the airflow is diffused because the speed of airflow in the rear-edge horizontal grooves 5 is different from that on the inter-groove projections 6*b*. The speed of airflow is also different between adjacent ones of the inter-groove projections 6*b*. Therefore, the airflow is diffused. Moreover, shed vortices at the rear edge interact with one another and cancel one another out. Thus, a further noise reduction is realized.

Referring to FIG. 11(*a*), the thickness at the groove recessed portion 5*a* of each rear-edge horizontal groove 5 is substantially the same as the thickness of a central portion (having a cavity) of the blade 4. Therefore, the depth (degree of recess) of the groove recessed portion 5*a* becomes smaller (decreases) toward the blade rear-edge portion 4*b*.

Referring to FIG. 11(*b*), the depth (degree of recess) of the groove recessed portion 5*a* of the rear-edge horizontal groove 5 is substantially uniform. Therefore, the thickness at the groove recessed portion 5*a* becomes smaller (decreases) toward the blade rear-edge portion 4*b*.

Referring to FIG. 11(*c*), the blade inner-circumferential surface 4*d* has a groove-type recess (hereinafter referred to as "negative-pressure-side groove recessed portion") 5*c* that reaches the groove wrapping portion 5*b*. Therefore, in combination with the groove recessed portion 5*a* provided in the blade inner-circumferential surface 4*d*, the above-described operational effects are promoted.

INDUSTRIAL APPLICABILITY

According to the present invention, sufficient air-sending efficiency is provided, and noise generation is suppressed. Therefore, the present invention is widely applicable to turbofans of different types and to indoor units of air-conditioning apparatuses for different types (not limited to the ceiling-concealed type) including the turbofans.

REFERENCE SIGNS LIST

1 turbofan, 1*a* fan air inlet, 1*b* fan air outlet, 2 main plate, 2*a* boss, 3 shroud, 4 blade, 4*a* blade front-edge portion, 4*a*1 blade front-edge end, 4*a*11 main-plate-side end point, 4*a*2 blade shroud-side front edge portion, 4*b* blade rear-edge portion, 4*b*1 blade rear-edge end, 4*b*11 main-plate-side end point, 4*b*12 shroud-side end point, 4*c* blade outer-circumferential surface, 4*d* blade inner-circumferential surface, 4*e* blade chord, 4*e*1 main-plate-side blade chord, 4*g* blade shroud-side joint, 5 rear-edge horizontal groove, 5*a* groove recessed portion, 5*b* groove wrapping portion, 5*c* negative-pressure-side groove recessed portion, 6 inter-groove surface portion, 6*a* inter-groove continuous surface, 6*b* inter-groove projection, 10 body, 10*a* top board, 10*b* side board, 10*c* body intake-air path, 10*d* body outflow-air path, 11 decorative panel, 11*a* air inlet grille, 11*b* panel fan-air outlet, 12 filter, 13 air-directing vane, 14 bellmouth, 15 fan motor, 16 heat exchanger, 17 room, 18 ceiling, 100 indoor unit, $\alpha$1 angle of bend at blade front-edge end, $\alpha$2 angle of bend at blade shroud-side joint, A direction of rotation, D1 groove width, D2 groove interval, H blade air-outlet height, H1 distance (region nearer to main plate where rear-edge horizontal grooves are provided), H2 distance (region nearer to shroud where rear-edge horizontal grooves are provided), L main-plate-side blade chord (blade chord length), L1 blade chord length subtracted by length of rear-edge horizontal groove, L2 length of rear-edge horizontal groove, L3 length of groove wrapping portion, L4 length of inter-groove projection, O center of rotation, P1 horizontal camber line, Q1 vertical camber line, T thickness, Y-Y cut position.

The invention claimed is:

1. A turbofan comprising a disc-shaped main plate having a boss projecting in a predetermined region containing a center of rotation; a ring-shaped shroud facing the main plate; and a plurality of blades each having two ends thereof joined to the main plate and the shroud, respectively, wherein a blade rear edge of each of the plurality of blades resides on a virtual cylinder defined by an outer circumference of the main plate and an outer circumference of the shroud, a blade front edge of each of the plurality of blades resides at a position nearer to the center of rotation than the blade rear edge, and a virtual line connecting the blade rear edge and the blade front edge is angled with respect to a radial line extending from the center of rotation, wherein a blade outer-circumferential surface, that is a surface of each of the plurality of blades farther from the center of rotation, has a plurality of rear-edge horizontal grooves having predetermined lengths reaching the blade rear edge, wherein the rear-edge horizontal grooves extend perpendicularly to the center of rotation and wrap around an end of the blade rear edge to a blade inner-circumferential surface that is a surface of each of the plurality of blades nearer to the center of rotation, and wherein the blade outer-circumferential surface of each of the plurality of blades has inter-groove surface portions extending between adjacent ones of the rear-edge horizontal grooves, and one of the inter groove surface portions is larger than other inter-groove surface portions.

2. The turbofan of claim 1, wherein a length (L2) of each of the rear-edge horizontal grooves is 10 to 50% of a linear distance (L) between an end of the blade front edge of each of the plurality of blades and the end of the blade rear edge ($0.1\times L \le L2 \le 0.5\times L$).

3. The turbofan of claim 1, wherein a groove width (D1) that is a width of each of the rear-edge horizontal grooves in a direction parallel to a rotating shaft is 50 to 100% of a groove interval (D2) that is an interval in the direction parallel to the rotating shaft between adjacent ones of the rear-edge horizontal grooves ($0.5\times D2 \le D1 \le 1.0\times D2$).

4. The turbofan of claim 1, wherein a groove width (D1) that is a width of each of the rear-edge horizontal grooves in a direction parallel to a rotating shaft is 2 to 5% of a fan air-outlet height (H) that is a distance in a direction parallel to the rotating shaft between the main plate and the shroud at the blade rear edge portion ($0.02\times H \le D1 \le 0.05\times H$).

5. The turbofan of claim 1, wherein the rear-edge horizontal grooves are provided in a region nearer to the shroud with respect to a midpoint between the main plate and the shroud.

6. The turbofan of claim 1, wherein the inter-groove surface portions included in the blade outer-circumferential surface extending between adjacent ones of the rear-edge horizontal grooves each include an inter-groove continuous surface that is continuous with the blade outer-circumferential surface, and an inter-groove projection that is provided in a predetermined region near the blade rear-edge portion and projects toward the outer circumferential side, and wherein a length of the inter-groove projection provided on one of the inter-groove surface portions is different from a length of another inter-groove projection provided on another one of the inter-groove surface portions that is adjacent to the former.

7. An indoor unit of an air-conditioning apparatus comprising:

a casing having an opening on one side thereof;

the turbofan of claim 1 provided in the casing; and a heat exchanger surrounding the turbofan, wherein an intake air path extending from a substantially central portion of the opening to the turbofan and an outflow air path extending from the turbofan through the heat exchanger to a peripheral portion of the opening are formed.

8. The turbofan of claim 1, wherein a groove width (D1) that is a width of each of the rear-edge horizontal grooves in a direction parallel to a rotating shaft is 50 to 100% of a groove interval (D2) that is an interval in the direction parallel to the rotating shaft between adjacent ones of the rear-edge horizontal grooves ($0.5\times D2 \leq D1 \leq 1.0\times D2$) and is 2 to 5% of a fan air-outlet height (H) that is a distance in a direction parallel to the rotating shaft between the main plate and the shroud at the blade rear edge portion ($0.02\times H \leq D1 \leq 0.05\times H$).

9. The turbofan of claim 1, wherein the rear-edge horizontal grooves are formed in a main plate side of the blade rear edge.

10. The turbofan of claim 1, wherein the rear-edge horizontal grooves are formed in a main plate side and a shroud side of the blade rear edge.

* * * * *